US008876526B2

(12) United States Patent
Auberger et al.

(10) Patent No.: US 8,876,526 B2
(45) Date of Patent: Nov. 4, 2014

(54) DELIVERY CHUTE FOR SINTER MATERIAL

(75) Inventors: Heinrich Auberger, Walding (AT); Edmund Fehringer, Linz (AT); Gerhard Fritzl, Perg (AT); Stephan Hattinger, Leonding (AT)

(73) Assignee: Siemens Vai Metals Technologies GmbH (AT)

( * ) Notice: Subject to any disclaimer, the term of this patent is extended or adjusted under 35 U.S.C. 154(b) by 436 days.

(21) Appl. No.: 13/392,636

(22) PCT Filed: Aug. 19, 2010

(86) PCT No.: PCT/EP2010/062082

§ 371 (c)(1),
(2), (4) Date: May 24, 2012

(87) PCT Pub. No.: WO2011/023621

PCT Pub. Date: Mar. 3, 2011

(65) Prior Publication Data

US 2012/0225394 A1 Sep. 6, 2012

(30) Foreign Application Priority Data

Aug. 26, 2009 (AT) ..... A 1343/2009

(51) Int. Cl.

| | |
|---|---|
| ***F27D 3/00*** | (2006.01) |
| ***F27D 15/02*** | (2006.01) |
| ***F27D 15/00*** | (2006.01) |
| ***F27B 21/00*** | (2006.01) |
| ***F27D 3/10*** | (2006.01) |
| *F27D 9/00* | (2006.01) |

(52) U.S. Cl.

CPC *F27D 3/10* (2013.01); *F27D 15/02* (2013.01); *F27D 3/0025* (2013.01); *F27D 15/00* (2013.01); *F27B 21/00* (2013.01); *F27D 3/0033* (2013.01); *F27D 2009/0094* (2013.01)

USPC ..... 432/235; 432/71

(58) Field of Classification Search

CPC ..... C04B 7/45; C22B 1/20; F27D 3/0033; F27D 3/10; F27D 15/02; F27D 15/09; F27D 1/20; B65G 11/023; B65G 11/12; B65G 11/166

USPC ..... 432/69, 71, 79, 83, 86, 161, 173, 190, 432/235, 239; 414/800, 804

See application file for complete search history.

(56) References Cited

U.S. PATENT DOCUMENTS 1,813,590 A * 7/1931 Stock, Jr. ..... 193/2 R
3,618,915 A * 11/1971 Heinemann et al. ..... 432/83

(Continued)

FOREIGN PATENT DOCUMENTS

CN 2924449 Y 7/2007 ..... F27B 21/10
CN 101036032 A 9/2007 ..... C22B 1/20

(Continued)

OTHER PUBLICATIONS

International PCT Search Report and Written Opinion, PCT/EP2010/062082, 9 pages, Oct. 14, 2010.

*Primary Examiner* — Gregory A Wilson
(74) *Attorney, Agent, or Firm* — Ostrolenk Faber LLP

(57) ABSTRACT

A delivery chute for delivering sinter material onto a sinter cooler and a method for delivering sinter material from a sinter belt onto a sinter cooler are provided. The sinter material introduced into the delivery chute may be divided by distributor plates into at least two sinter material subflows flowing in different directions, which may be guided into the edge regions of a sinter material total flow obtained by combining them.

18 Claims, 1 Drawing Sheet

(56) References Cited

U.S. PATENT DOCUMENTS

| | | | | |
|---|---|---|---|---|
| 4,323,384 | A * | 4/1982 | Meunier | 65/335 |
| 4,728,288 | A * | 3/1988 | Niems | 432/78 |
| 5,181,633 | A * | 1/1993 | Weber et al. | 222/195 |
| 7,604,447 | B2 * | 10/2009 | Cimenti et al. | 414/299 |
| 7,811,086 | B2 | 10/2010 | Laaber et al. | 432/239 |
| 8,666,557 | B2 * | 3/2014 | Tockert et al. | 700/282 |
| 2008/0108006 | A1 | 5/2008 | Laaber et al. | 432/239 |
| 2011/0132242 | A1 * | 6/2011 | Craig et al. | 110/267 |
| 2011/0311926 | A1 * | 12/2011 | Tockert et al. | 432/1 |
| 2012/0225394 | A1 | 9/2012 | Auberger et al. | 432/1 |

FOREIGN PATENT DOCUMENTS

| | | | | |
|---|---|---|---|---|
| CN | 101050921 | A | 10/2007 | F27D 3/10 |
| CN | 201158688 | Y | 12/2008 | C22B 1/16 |
| DE | 2829093 | A1 | 1/1980 | F27D 15/02 |
| JP | 62129687 | | 8/1987 | |
| JP | 2005281810 | A | 10/2005 | |
| SU | 1388687 | A1 | 4/1988 | F27B 21/06 |
| SU | 1532791 | A1 | 12/1989 | F27B 21/06 |
| WO | 98/52580 | | 11/1998 | B65G 47/72 |
| WO | 2006/015680 | A1 | 2/2006 | F27B 21/06 |
| WO | 2011/023621 | A1 | 3/2011 | F27B 15/00 |

* cited by examiner

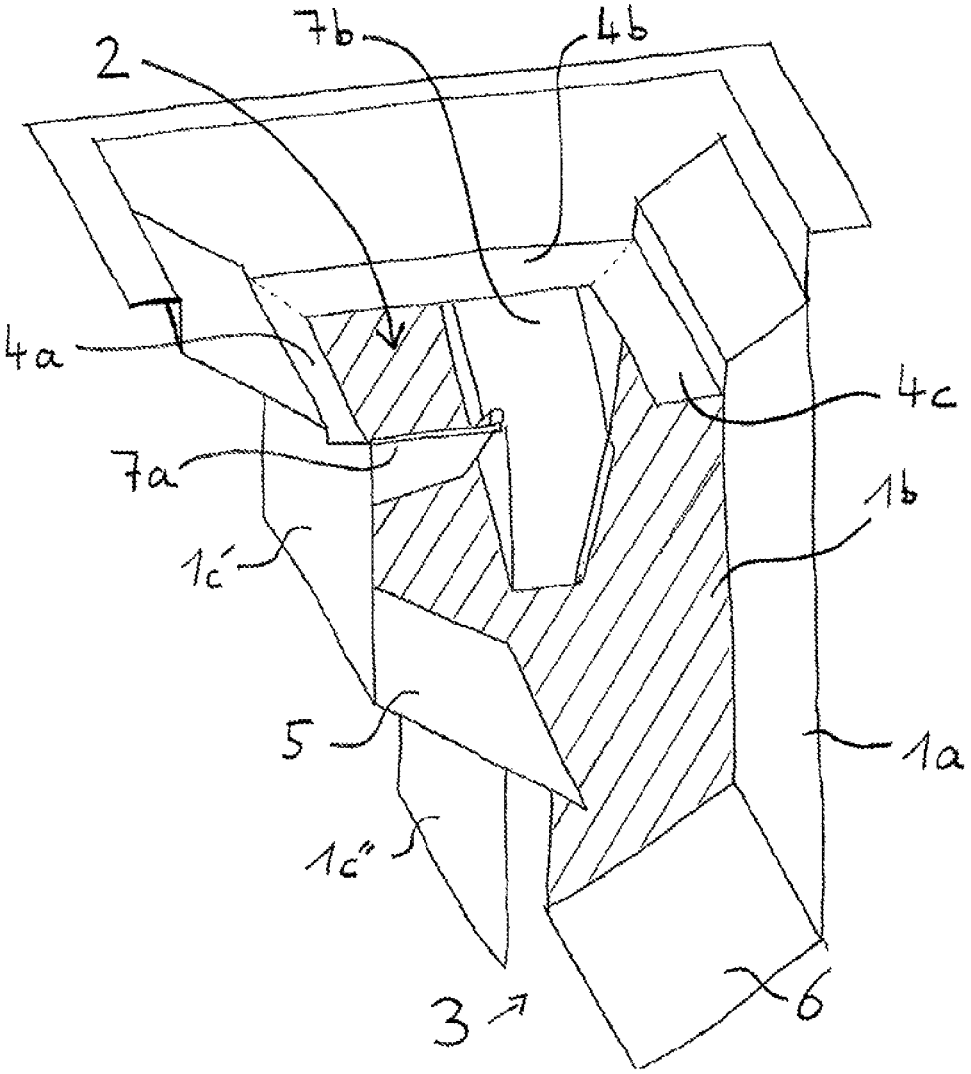
2
7b
4b
4a
4c
7a
1b
1c'
5
1a
1c''
3
6

DELIVERY CHUTE FOR SINTER MATERIAL

CROSS-REFERENCE TO RELATED APPLICATIONS

This application is a U.S. National Stage Application of International Application No. PCT/EP2010/062082 filed Aug. 19, 2010, which designates the United States of America, and claims priority to Austrian Patent Application No. A1343/2009 filed Aug. 26, 2009. The contents of which are hereby incorporated by reference in their entirety.

TECHNICAL FIELD

The present disclosure relates to a delivery chute for delivering sinter material onto a sinter cooler and to a method for delivering sinter material from a sinter belt onto a sinter cooler.

BACKGROUND

In order to cool a hot granular sinter material produced in a sintering apparatus, it may be delivered onto a moving sinter cooler. There, cooling is carried out using a machine-generated air flow which may be fed from below through the hot granular sinter material placed on the cooling bed of the sinter cooler. The particle size distribution of the granular sinter material on the cooling bed may have an effect on the efficiency of the cooling, since the particle size distribution determines the resistance opposing the air flow. The effect of a resistance having a different strength in different regions of the sinter material may be that the air flow does not flow, or flows only to a lesser extent, through areas with an increased resistance and the sinter material is therefore not uniformly cooled. The effect of nonuniform cooling may be that different grains of the sinter material discharged from the sinter cooler have different temperatures. Grains with temperatures above a desired discharge temperature can cause damage to subsequent apparatus processing the cooled sinter material, for example conveyor belts and sizing screens.

The horizontal and vertical particle size distribution in the sinter material on the cooling bed of the sinter cooler may be influenced by the delivery chute through which the crushed sinter material is delivered from the sinter belt onto the sinter cooler. Certain conventional delivery chutes include a shaft delimited by side walls, with an inlet opening lying at the top for introducing the granular sinter material to be cooled, and an outlet opening lying at the bottom, through which the granular sinter material to be cooled is delivered onto the cooling bed of the sinter cooler. The outlet opening lies between side walls of the shaft and a downwardly inclined base plate of the delivery chute. Inside the shaft, a downwardly inclined inlet guide plate, by which a sliding movement extending obliquely downward is imparted to the granular material introduced into the shaft, extends on the inlet opening. Between the inlet guide plate and side walls of the delivery chute, an opening is left through which the sinter material can move following the force of gravity in the direction of the outlet opening. Below this opening, a downwardly inclined deflection plate is arranged in the shaft. Since the deflection plate has a different inclination direction to the inlet guide plate, the sinter material total flow which flows through the delivery chute has a sliding movement with a different direction imparted to it by the deflection plate. Between the deflection plate and the delivery chute shaft's side wall lying opposite the lower end of the deflection plate, an opening remains through which the sinter material can move following the force of gravity in the direction of the outlet opening. The base plate, whose inclination direction is different to that of the deflection plate, is usually arranged below this opening. When the deflection plate and the base plate respectively have opposite inclination directions to one another, then it is known that the sinter material total flow which leaves the delivery chute through the outlet opening has a particle size distribution gradient extending over the thickness of the outgoing sinter material total flow owing to segregation phenomena on the sinter-material filling of the delivery chute taking place when it passes through the delivery chute. This can be utilized in order for a moving cooling bed of the sinter cooler, lying below the outlet opening, to be loaded so that the particle size of the sinter material in the layer on the cooling bed predominantly decreases from the bottom upward as seen over the width of the cooling bed, i.e., there is a particle size distribution gradient over the thickness of the layer. A decrease in the particle size from the bottom upward may allow efficient cooling, since a cooling air flow which is delivered from below is thereby opposed with less resistance when it enters the layer. Furthermore, more heat may be stored in the particles of the sinter material with a larger particle size than in particles of the sinter material with a smaller particle size, for which reason initial contact of the cooling air flow with particles of a large particle size leads to more efficient cooling.

A disadvantage with certain conventional apparatus, however, is that the gradient of the particle size distribution may extend very nonuniformly over the total width of the moving cooling bed, or is partly absent, in particular when the sinter belt moves substantially perpendicularly to the movement direction of the sinter cooler at the delivery opening. This is because coarser-grained and therefore heavier particles of the sinter material have a greater kinetic energy in the direction of the movement direction of the sinter belt than smaller particles, and they correspondingly strike the inlet guide plate further away from the sinter belt. The coarser-grained material may arrive correspondingly more concentrated in the region of the corresponding edge of the sinter material total flow in the delivery chute. This inhomogeneous distribution may furthermore still exist on the cooling bed of the sinter cooler, for which reason uniform cooling of the sinter material by the cooling air flow may not be ensured because the resistance presented to the air flow by the sinter material may vary over the width of the cooling bed.

SUMMARY

In one embodiment, a method for delivering sinter material from a sinter belt onto a sinter cooler by means of a delivery chute is provided. The sinter material leaving the sinter belt may be introduced into the delivery chute, optionally after a crushing process. Then the sinter material may be divided by distributor plates into at least two sinter material subflows flowing in different directions, each sinter material subflow having its flow direction dictated by the distributor plate over which it flows. The flow directions of the sinter material subflows may be represented by subflow flow-direction vectors and, for the angle made by the subflow flow-direction vectors with a horizontal plane, with angles measured in the same direction, for a pair of directly neighboring sinter material subflows. The subflow flow-direction vector of one sinter material subflow may make an obtuse angle with the horizontal plane and the subflow flow-direction vector of the other sinter material subflow makes an acute angle with the horizontal plane. Then the sinter material subflows may be combined into a sinter material total flow flowing obliquely downward, the flow direction of which is represented by a total flow flow-direction vector, the horizontal principal components of the subflow flow-direction vectors being substantially perpendicular to the horizontal principal component of the total flow flow-direction vector, and the sinter material subflows ma be guided into the lateral edges of the sinter material total flow as seen in the flow direction of the sinter material total flow. Then the sinter material total flow may be delivered onto a sinter cooler after at least one reversal of its flow direction by the base plate of the delivery chute.

In a further embodiment, the horizontal principal components of the subflow flow-direction vectors of two directly neighboring subflows have opposite directions. In a further embodiment, the movement directions of the sinter material subflows are inclined downward to the same extent. In a further embodiment, In another embodiment, a delivery chute for delivering sinter material onto a sinter cooler is provided. The delivery chute may include: a shaft delimited by side walls having an inlet opening at the top, which is bounded by the side walls of the shaft and/or by bounding plates which start from the side walls of the shaft and extend into the space bounded by the shaft, and an outlet opening at the bottom, at least one deflection plate arranged inside the shaft and optionally inclined downward, which may be connected to two mutually opposite side walls of the shaft and a side wall connecting them, and a base plate optionally inclined downward, which may be connected to two mutually opposite side walls and a side wall connecting them. A gap may exist between at least one of the side walls of the shaft and the deflection plate, and the outlet opening may be located between the base plate and the lower end of at least one side wall. The base plate may be directly arranged vertically below the gap between the side wall and the deflection plate directly neighboring the base plate and arranged vertically over it. A distributor device may be arranged between the inlet opening and the first deflection plate inside the shaft, as seen from the inlet opening in the vertical direction, which may comprise at least two downwardly inclined distributor plates which are inclined downward so that, for the angles measured in the same direction between a horizontal plane and the distributor plates, for a pair of directly neighboring distributor plates one of the distributor plates makes an obtuse angle with the horizontal plane and the other of the distributor plates makes an acute angle with the horizontal plane. Each of the distributor plates—as seen from its higher-lying end in the direction of its lower-lying end—may extend in the direction of one of the side edges, optionally with a profile inclined downward, of the deflection plate directly arranged vertically below it.

In a further embodiment, the vertical projections of the distributor plates onto a horizontal plane may lie inside the perpendicular projection of the first deflection plate, as seen from the inlet opening, onto the same horizontal plane.

In a further embodiment, the distributor plates may be inclined downward to the same extent. In a further embodiment, for a pair of directly neighboring distributor plates, the two distributor plates of the pair may be inclined in mutually opposite directions. In a further embodiment, the higher-lying ends of the distributor plates may lie at the same position with respect to the vertical lengthwise extent of the shaft.

BRIEF DESCRIPTION OF THE DRAWING

Example embodiments will be explained in more detail below with reference to FIG. 1, which shows an oblique view of a longitudinal section through a delivery chute according to an example embodiment.

DETAILED DESCRIPTION

Some embodiment provide a method for delivering sinter material from a sinter belt onto a sinter cooler by means of a delivery chute, and a delivery chute, with which an improved uniformity of the particle size distribution of sinter material on the cooling bed of a sinter cooler may be achieved in comparison with certain conventional systems.

Some embodiments provide a method for delivering sinter material from a sinter belt onto a sinter cooler by means of a delivery chute, wherein the sinter material leaving the sinter belt is introduced into the delivery chute, optionally after a crushing process, then the sinter material is divided by distributor plates into at least two sinter material subflows flowing in different directions, each sinter material subflow having its flow direction dictated by the distributor plate over which it flows, and wherein the flow directions of the sinter material subflows are represented by subflow flow-direction vectors and, for the angle made by the subflow flow-direction vectors with a horizontal plane, with angles measured in the same direction, for a pair of directly neighboring sinter material subflows the subflow flow-direction vector of one sinter material subflow makes an obtuse angle with the horizontal plane and the subflow flow-direction vector of the other sinter material subflow makes an acute angle with the horizontal plane then the sinter material subflows are combined into a sinter material total flow flowing obliquely downward, the flow direction of which is represented by a total flow flow-direction vector, the horizontal principal components of the subflow flow-direction vectors being substantially perpendicular to the horizontal principal component of the total flow flow-direction vector, and the sinter material subflows being guided into the lateral edges of the sinter material total flow as seen in the flow direction of the sinter material total flow, and then the sinter material total flow is delivered onto a sinter cooler after at least one reversal of its flow direction by the base plate of the delivery chute.

According to certain embodiments, the sinter material introduced into the delivery chute may be initially divided into two sinter material subflows flowing in different directions. This separation may be carried out by delivering the sinter material onto distributor plates provided with a different inclination downward, which respectively dictate the flow direction for the subflows. The flow directions of the sinter material subflows may be represented by flow-direction vectors. The flow directions of the sinter material subflows may differ in that for directly neighboring sinter material subflows, different types of angles are formed between the flow-direction vectors and a horizontal plane. One of the angles may be an obtuse angle, and the other may be an acute angle. The angles are measured in the same direction.

The sinter material subflows may be combined into a sinter material total flow, the combining being carried out so that the subflows may be guided in the direction of the two lateral edges of the sinter material total flow, at least one subflow respectively being guided in the direction of each lateral edge. The sinter material total flow, obtained by combining the sinter material subflows, may flow obliquely downward. Its lateral edges, as viewed in the flow direction, may essentially bear on side walls of the shaft of the delivery chute.

The flow direction of the sinter material total flow, obtained by combining the sinter material subflows, may be represented by a total flow flow-direction vector.

The subflow flow-direction vectors and the total flow flow-direction vector may be respectively the sum of vectors following the three coordinate axes in a three-dimensional orthogonal coordinate system, two of which lie in a horizontal plane and one of which is perpendicular to this plane. The subflow flow-direction vectors and the total flow flow-direction vector lie in a plane containing one of the horizontally extending coordinate axes and the vertically extending coordinate axis. That of the vectors, following the three coordinate axes and lying in the horizontal plane, which has the greater magnitude, may be referred to as the horizontal principal component of a subflow or total flow flow-direction vector. According to certain embodiments, the horizontal principal components of the subflow flow-direction vectors may be substantially perpendicular to the horizontal principal component of the total flow flow-direction vector. The term substantially perpendicular is intended to mean an angle range of 90+/−25°, preferably 90+/−20°, particularly preferably 90+/−15°, more particularly preferably 90+/−10°, and most especially preferably 90+/−5°. The angle actually selected may depend inter alia on the horizontally measured distance to the inlet opening from the outlet opening and/or the overall height of the delivery chute.

The method steps according to certain embodiments may reduce the effect, caused by a nonuniform distribution of grains of different particle sizes prevailing in the sinter material introduced into the delivery chute, on the particle size distribution in the sinter material total flow. This is because depending on the sinter material subflow with which sinter material introduced into the delivery chute flows, it may be guided to one or the other lateral edge of the sinter material total flow. As a result of this, in contrast to certain conventional systems, a particularly concentrated particle size in a subregion of the flow of sinter material introduced into the delivery chute may not accumulate on a corresponding lateral edge of the sinter material total flow in the delivery chute. Here, the term lateral edge is to be understood as meaning that the sinter material total flow obtained by combining the sinter material subflows is considered in its flow direction, the sinter material total flow having two edges, namely a right edge and a left edge.

The delivery of the sinter material total flow subsequently taking place onto the sinter cooler may be carried out after at least one reversal of its flow direction by the base plate of the delivery chute.

In some embodiments, the horizontal principal components of the subflow flow-direction vectors of two directly neighboring subflows may have opposite directions, that is to say they may lie at an angle of 180° to one another. They may, however, also lie at a smaller angle to one another, for instance 175°, 170°, 165°, 160°, 155°, i.e., in an angle range of from 155° to 180°.

According to one embodiment, the movement directions of the sinter material subflows may be inclined downward to the same extent. They may, however, also be inclined downward to a different extent, in which case the angle of inclination may differ by up to 15°, for instance 5°, 10°. The angle actually selected may depend inter alia on the horizontally measured distance to the inlet opening from the outlet opening and/or the overall height of the delivery chute.

Some embodiments may provide a delivery chute for delivering sinter material onto a sinter cooler, comprising a shaft delimited by side walls having an inlet opening at the top, which is bounded by the side walls of the shaft and/or by bounding plates which start from the side walls of the shaft and extend into the space bounded by the shaft, and an outlet opening at the bottom, at least one deflection plate arranged inside the shaft and optionally inclined downward, which is connected to two mutually opposite side walls of the shaft and a side wall connecting them, and a base plate optionally inclined downward, which is connected to two mutually opposite side walls and a side wall connecting them. A gap may be defined between at least one of the side walls of the shaft and the deflection plate, and the outlet opening may be located between the base plate and the lower end of at least one side wall. The base plate may be directly arranged vertically below the gap between the side wall and the deflection plate directly neighboring the base plate and arranged vertically over it. A distributor device may be arranged between the inlet opening and the first deflection plate inside the shaft, as seen from the inlet opening in the vertical direction, and may include at least two downwardly inclined distributor plates which are inclined downward so that, for the angles measured in the same direction between a horizontal plane and the distributor plates, for a pair of directly neighboring distributor plates one of the distributor plates makes an obtuse angle with the horizontal plane and the other of the distributor plates makes an acute angle with the horizontal plane, and wherein each of the distributor plates—as seen from its higher-lying end in the direction of its lower-lying end—extends in the direction of one of the side edges, optionally with a profile inclined downward, of the deflection plate directly arranged vertically below it.

The method according to certain embodiments disclosed herein can be carried out with the delivery chute according to certain embodiments disclosed herein.

In some embodiments, the shaft of the delivery chute may be delimited by side walls and may have an inlet opening and an outlet opening. The sinter material is introduced through the inlet opening, and it is discharged through the outlet opening. At least one deflection plate may be arranged inside the shaft. It may be connected to two mutually opposite side walls of the shaft, and to a side wall connecting the two side walls. The lateral edges of the deflection plate, which respectively extend along the shaft's two mutually opposite side walls to which the deflection plate is connected, may be referred to as side edges of the deflection plate. The deflection plate may be arranged inclined, and specifically inclined downward. In this case the lateral edges of the deflection plate as seen from the higher-lying end in the direction of its lower-lying end, which are referred to as side edges, may extend with an inclination downward.

Alternatively, however, the deflection plate may be arranged without an inclination, i.e., in a horizontal plane. Between at least one of the side walls of the shaft and the deflection plate, there may be a gap through which the sinter material contained in the delivery chute can move following the force of gravity downward in the direction of the outlet opening. This gap may be located at the lower-lying end of the deflection plate, for example between the lower-lying end of the deflection plate and the side wall which lies opposite the side wall connected to the higher-lying end of the deflection plate. If the deflection plate is not inclined, the gap may be located between the deflection plate's end not connected to a side wall of the shaft and the side wall lying opposite this end.

The outlet opening may lies between the base plate and the lower end of at least one side wall. The base plate may be connected to two mutually opposite side walls and a side wall connecting them. The base plate may be directly arranged vertically below the gap between the side wall and the deflection plate directly neighboring the base plate and arranged vertically over the base plate. The base plate may be arranged inclined, and specifically inclined downward. If both the base plate and the deflection plate are inclined, the base plate is inclined in a different direction to the deflection plate. The outlet opening may not lie vertically, as seen from the inlet opening, directly below the gap between the side wall and the deflection plate directly neighboring the base plate and arranged vertically over the base plate. In this way, the movement direction of the sinter material total flow may be again changed at least once by the base plate after passing through the gap, before it emerges from the delivery chute through the outlet opening.

Irrespective of whether the deflection plate and/or base plate are inclined or not inclined, in certain embodiments the method may proceed in the same way because, on a non-inclined deflection plate and/or base plate, a pile of material may be formed whose surface is inclined as a function of the resting angle of the sinter material. The sinter material total flow may thus also flow obliquely downward along this surface in the case of a non-inclined deflection plate and/or base plate, as it does in the case of an inclined deflection plate and/or base plate.

In some embodiments, a distributor device may be arranged inside the shaft between the inlet opening and the first deflection plate inside the shaft, as seen from the inlet opening. It may include at least two downwardly inclined distributor plates. The distributor plates may be inclined downward so that, for the angle between a horizontal plane and a distributor plate, for a pair of directly neighboring distributor plates one of the distributor plates makes an obtuse angle with the horizontal plane and the other of the distributor plates makes an acute angle with the horizontal plane. The angles between the horizontal plane and the distributor plates are in this case measured in the same direction. The individual distributor plates or all the distributor plates may be connected to a side wall of the shaft at their higher-lying end and extend—as seen from its higher-lying end in the direction of their lower-lying end—in the direction of one of the side edges, with a profile inclined downward, of the deflection plate directly arranged vertically below it.

The deflection plates may have the same width everywhere over their lengthwise extent from their upper end to their lower end, or they may become narrower toward the lower end.

The vertical projections of the distributor plates onto a horizontal plane may lie inside the perpendicular projection of the first deflection plate, as seen from the inlet opening, onto the same horizontal plane. The distributor plates may thus not be arranged over the gap between the deflection plate and the side wall. This may ensure that incoming sinter material cannot be discharged from the delivery chute without deflection by the distributor plates.

According to certain embodiments, the distributor plates may be inclined downward to the same extent. This means that the magnitudes of the angles, by which the longitudinal axes of the distributor plates are inclined downward relative to the horizontal, are the same. They may however also be inclined downward to a different extent, in which case the angle of inclination may differ by up to 15°, for instance 5°, 10°. The angle actually selected may depend inter alia on the horizontally measured distance to the inlet opening from the outlet opening, as well as the overall height of the delivery chute.

Neighboring distributor plates may be inclined in different directions. According to one embodiment, for a pair of directly neighboring distributor plates, the two distributor plates of the pair may be inclined in mutually opposite directions. This means that in relation to a reference point, the right-hand end of one distributor plate lies higher than its left-hand end, i.e., the distributor plate is inclined downward from right to left. A directly neighboring distributor plate have a left-hand end lying higher, so that it is inclined downward from left to right. The two distributor plates of the pair are then inclined in mutually opposite directions.

In some embodiments, the higher-lying ends of the distributor plates lie at the same position with respect to the vertical lengthwise extent of the shaft. They may, however, also be located at different positions with respect to the vertical lengthwise extent of the shaft. The position actually selected depends inter alia on the horizontally measured distance to the inlet opening from the outlet opening, as well as the overall height of the delivery chute.

In some embodiments, the relationships between the horizontal principal components of the subflow flow-direction vectors and the horizontal principal component of the total flow flow-direction vector apply at least so long as the total flow lies on the first deflection plate in the vertical direction, as seen from the inlet opening.

FIG. 1 shows an oblique view of a longitudinal section through a delivery chute according to an example embodiment. The shaft of the delivery chute is delimited by side walls 1*a*, 1*b*, the side wall 1*c* consisting of the parts 1*c*' and 1*c*", and a further side wall which is not represented owing to the longitudinal section and extends parallel to the side wall 1*b*. For better clarity, the side wall 1*b* is shaded. The inlet opening 2 is provided at the top, and an outlet opening 3 is provided at the bottom. The inlet opening is bounded by bounding plates 4*a*, 4*b*, 4*c* starting from the side walls, and a further bounding plate which is not represented owing to the longitudinal section. The deflection plate 5 is arranged inside the shaft. It is inclined downward and connected to the side wall 1*b*, the side wall (not shown) parallel to 1*b*, and the parts 1*c*' and 1*c*". The lateral edges of the deflection plate as seen from the higher-lying end of the deflection plate in the direction of its lower-lying end, which are referred to as side edges, of the deflection plate extend with an inclination downward. Between the side wall 1*a* and the deflection plate 5, there is a gap. A base plate 6 is arranged directly below the gap vertically. The base plate 6 is inclined downward, the direction of the inclination of the base plate 6 differing from the direction of the inclination of the deflection plate 5; while the base plate 6 represented in FIG. 1 is inclined downward from right to left, the deflection plate 5 is inclined downward from left to right. The base plate is connected to the side wall 1*b*, the side wall (not shown) parallel to 1*b*, and the side wall 1*a*. The outlet opening 3 is located between the lower end of the part 1*c*" of the side wall 1*c* and the base plate 6.

A distributor device, comprising the two directly neighboring distributor plates 7*a* and 7*b*, may be arranged between the inlet opening 2 and the deflection plate 5. The two distributor plates 7*a* and 7*b* are inclined downward. They become narrower toward their lower-lying end, as can be seen for the distributor plate 7*b*. The distributor plates 7*a* and 7*b* are inclined in different directions to one another, namely in mutually opposite directions. The two distributor plates 7*a* and 7*b* are inclined downward to the same extent. With a horizontal plane, for example passing through the distributor opening, the distributor plate 7*a* with a corresponding direction of the angle measurement makes an acute angle, while the distributor plate 7*b* with the same direction of the angle measurement makes an obtuse angle with the same horizontal plane. The distributor plate 7*b* is connected to the side wall 1*b* by its higher-lying end, while the distributor plate 7*a* is connected to the side wall (not shown) parallel thereto by its higher-lying end. Each of the distributor plates extends in the direction of one of the side edges, extending with a downward inclination, of the deflection plate 5. The distributor plate 7*a* extends in the direction of the side edge which neighbors the side wall 1*b*, and the distributor plate 7*b* extends in the direction of the other side edge of the deflection plate 5. The distributor plates 7*a* and 7*b* are arranged so that their perpendicular projections onto a horizontal plane lie inside the perpendicular projections of the deflection plate 5 onto the same horizontal plane. The distributor plates 7*a* and 7*b* do not directly lie vertically over the gap between the deflection plate 5 and the side wall 1*a*.

Sinter material introduced into the delivery chute may be divided by the two distributor plates 7*a* and 7*b* into two sinter material subflows which the flow with flow directions dictated by the distributor plates 7*a* and 7*b* in the direction of the side edges of the deflection plate. The sinter material subflows leaving the distributor plates 7*a* and 7*b* are combined into a sinter material total flow, which flows down the deflection plate 5. The horizontal principal components of the total flow vector and the subflow flow-direction vectors may be mutually perpendicular. A reversed flow direction may subsequently be imparted to the sinter material total flow by the base plate, before the sinter material is delivered through the outlet opening 3 onto the sinter cooler.

LIST OF NUMBERED ELEMENTS

1*a*, 1*b*, 1*c* side walls
1*c*', 1*c*" parts of the side wall 1*c*
2 inlet opening
3 outlet opening
4*a*, 4*b*, 4*c* bounding plates
5 deflection plate
6 base plate
7*a*,7*b* distributor plates

What is claimed is:

1. A method for delivering sinter material from a sinter belt onto a sinter cooler by means of a delivery chute, comprising:

introducing the sinter material leaving the sinter belt into the delivery chute, dividing the sinter material by distributor plates into at least two sinter material subflows flowing in different directions, each sinter material subflow having its flow direction dictated by the distributor plate over which it flows, and wherein the flow directions of the sinter material subflows are represented by subflow flow-direction vectors and, for the angle made by the subflow flow-direction vectors with a horizontal plane, with angles measured in the same direction, for a pair of directly neighboring sinter material subflows, the subflow flow-direction vector of one sinter material subflow makes an obtuse angle with the horizontal plane and the subflow flow-direction vector of the other sinter material subflow makes an acute angle with the horizontal plane, combining the sinter material subflows into a sinter material total flow flowing obliquely downward, the flow direction of which is represented by a total flow flow-direction vector, the horizontal principal components of the subflow flow-direction vectors being substantially perpendicular to the horizontal principal component of the total flow flow-direction vector, wherein the sinter material subflows are guided into the lateral edges of the sinter material total flow as seen in the flow direction of the sinter material total flow, and delivering the sinter material total flow onto a sinter cooler after at least one reversal of its flow direction by the base plate of the delivery chute.

2. The method of claim 1, characterized in that the horizontal principal components of the subflow flow-direction vectors of two directly neighboring subflows have opposite directions.

3. The method of claim 1, characterized in that the movement directions of the sinter material subflows are inclined downward to the same extent.

4. The method of claim 1, wherein the introducing the sinter material is introduced into the delivery chute after a crushing process.

5. A delivery chute for delivering sinter material onto a sinter cooler, comprising:

a shaft delimited by side walls having an inlet opening at the top, which is bounded by at least one of (a) the side walls of the shaft and (b) bounding plates which that start from the side walls of the shaft and extend into a space bounded by the shaft, an outlet opening at a bottom of the delivery chute, deflection plate arranged inside the shaft and connected to two mutually opposite side walls of the shaft and a side wall connecting them, a base plate connected to two mutually opposite side walls and a side wall connecting the opposite side walls, wherein a gap is defined between at least one of the side walls of the shaft and the deflection plate, wherein the outlet opening is located between the base plate and the lower end of at least one side wall, wherein the base plate is arranged vertically below the gap between the side wall and the deflection plate, wherein a distributor device is arranged between the inlet opening and the deflection plate inside the shaft, as seen from the inlet opening in the vertical direction, the distributor device comprising at least two downwardly inclined distributor plates inclined downward so that, for angles measured in the same direction between a horizontal plane and the distributor plates, for a pair of directly neighboring distributor plates, one of the distributor plates makes an obtuse angle with the horizontal plane and the other of the distributor plates makes an acute angle with the horizontal plane, and wherein at least one of the distributor plates extends in a direction of a side edges of the deflection plate.

6. The delivery chute of claim 5, wherein the vertical projections of the distributor plates onto a horizontal plane lie inside the perpendicular projection of the deflection plate, as seen from the inlet opening, onto the same horizontal plane.

7. The delivery chute claim 5, wherein the distributor plates are inclined downward to the same extent.

8. The delivery chute of claim 5, wherein for a pair of directly neighboring distributor plates, the two distributor plates of the pair are inclined in mutually opposite directions.

9. The delivery chute of claim 5, comprising a plurality of deflecting plates, wherein a higher-lying ends of each distributor plates lies at the same position with respect to the vertical direction of the shaft.

10. The delivery chute of claim 5, wherein the deflecting plate is downward.

11. The delivery chute of claim 5, comprising a plurality of deflecting plates, each arranged inside the shaft and connected to two mutually opposite side walls of the shaft and a side wall connecting the opposite side walls.

12. A delivery chute for delivering sinter material onto a sinter cooler, comprising:

a shaft defined by side walls and defining an inlet opening at a top of the delivery chute and an outlet opening at a bottom of the delivery chute, a deflection plate arranged inside the shaft and connected to at least two of the shaft side walls, the deflection plate extending from a first shaft side wall in a direction generally diagonal with respect to a vertical direction of the shaft, wherein a deflection gap is defined between a lower edge of the deflection plate and a second shaft side wall opposite the first shaft side wall, a base plate connected to at least two of the side walls of the shaft, the base plate arranged vertically below the deflection gap, wherein the outlet opening is located between the base plate and the lower end of at least one side wall, a distributor device is arranged between the inlet opening and the deflection plate in the vertical direction of the shaft, the distributor device including at least two downwardly inclined distributor plates inclined downward so that, for angles measured in the same direction between a horizontal plane and the distributor plates, one of the distributor plates makes an obtuse angle with the horizontal plane and the other of the distributor plates makes an acute angle with the horizontal plane.

13. The delivery chute of claim 12, wherein at least one of the distributor plates extends in the same direction as a side edge of the deflection plate.

14. The delivery chute of claim 12, wherein the outlet opening is located directly below the deflection plate.

15. The delivery chute of claim 14, wherein the vertical projections of the distributor plates onto a horizontal plane lie inside a perpendicular projection of the deflection plate, as seen from the inlet opening, onto the same horizontal plane.

16. The delivery chute of claim 14, wherein the distributor plates are inclined downward to the same extent.

17. The delivery chute of claim 14, wherein for a pair of directly neighboring distributor plates, the two distributor plates of the pair are inclined in mutually opposite directions.

18. The delivery chute of claim 14, comprising a plurality of deflecting plates, wherein an upper end of each distributor plate lies at the same position with respect to the vertical direction of the shaft.

* * * * *